US010653294B2

(12) United States Patent
Mathew

(10) Patent No.: US 10,653,294 B2
(45) Date of Patent: May 19, 2020

(54) ROTATING DOOR MAT ASSEMBLY

(71) Applicant: Oommen Chundamannil Mathew, Downingtown, PA (US)

(72) Inventor: Oommen Chundamannil Mathew, Downingtown, PA (US)

( * ) Notice: Subject to any disclaimer, the term of this patent is extended or adjusted under 35 U.S.C. 154(b) by 0 days.

(21) Appl. No.: 16/097,633

(22) PCT Filed: Apr. 20, 2018

(86) PCT No.: PCT/US2018/028471
§ 371 (c)(1),
(2) Date: Oct. 30, 2018

(87) PCT Pub. No.: WO2018/195371
PCT Pub. Date: Oct. 25, 2018

(65) Prior Publication Data

US 2020/0029785 A1 Jan. 30, 2020

Related U.S. Application Data

(60) Provisional application No. 62/488,194, filed on Apr. 21, 2017.

(51) Int. Cl.
*A47L 23/26* (2006.01)

(52) U.S. Cl.
CPC ..... *A47L 23/266* (2013.01)

(58) Field of Classification Search
CPC ..... A47L 23/266; A47L 23/26; A47L 23/263
USPC ..... 15/215–217
See application file for complete search history.

(56) References Cited

U.S. PATENT DOCUMENTS

| | | | | |
|---|---|---|---|---|
| 1,008,618 | A * | 11/1911 | Skowronski et al. | A47L 23/26 15/216 |
| D171,301 | S * | 1/1954 | Kravitz | B32B 5/06 D6/583 |
| 4,029,834 | A | 6/1977 | Bartlett | |
| 4,647,081 | A | 3/1987 | Landgraf et al. | |
| 4,877,672 | A | 10/1989 | Shreiner | |
| 5,332,347 | A | 7/1994 | Kimisawa | |
| 5,958,538 | A * | 9/1999 | Kessler | A47L 23/24 15/215 |

(Continued)

FOREIGN PATENT DOCUMENTS

| | | |
|---|---|---|
| DE | 299 080823 | 9/1999 |
| WO | WO00/16682 | 3/2000 |
| WO | WO2004/045362 | 6/2004 |

OTHER PUBLICATIONS

International Search Report for PCT/US2018/028471, dated Jul. 24, 2018. 11 pages.

(Continued)

*Primary Examiner* — Weilun Lo
(74) *Attorney, Agent, or Firm* — Joseph E. Maenner; Petock & Petock, LLC

(57) ABSTRACT

In described embodiments, a door mat assembly includes a base frame having a top surface. A first mat insert is removably attached to the base frame. The first mat insert has a first inner surface and a first outer surface. A second mat insert is removably attached to the base frame and hingedly connected to the first mat insert. The second mat insert has a second inner surface and a second outer surface. A first frame pivot assembly is rotatably inserted in the base frame and is adapted to allow the first mat insert and the second mat insert to rotate about the first frame pivot assembly.

12 Claims, 14 Drawing Sheets

(56) References Cited

U.S. PATENT DOCUMENTS

| | | | | |
|---|---|---|---|---|
| 6,258,202 | B1 | 7/2001 | Callas | |
| 6,534,146 | B1 | 3/2003 | Mentz | |
| 7,043,792 | B2 | 5/2006 | Kessler | |
| 8,298,644 | B2 | 10/2012 | Booth | |
| 2001/0004483 | A1 | 6/2001 | Blum | |
| 2005/0287330 | A1 | 12/2005 | Kessler | |
| 2006/0046023 | A1* | 3/2006 | Clewell | A47L 23/266 428/131 |
| 2007/0202293 | A1 | 8/2007 | Powell | |
| 2008/0263922 | A1* | 10/2008 | Ho | G09F 19/22 40/508 |
| 2009/0297736 | A1* | 12/2009 | Keighley | A47L 23/266 428/12 |
| 2011/0189425 | A1* | 8/2011 | Booth | B60N 3/042 428/74 |
| 2011/0318523 | A1* | 12/2011 | Todd | A47G 27/0225 428/67 |
| 2014/0223684 | A1* | 8/2014 | Hawkins | A47L 23/266 15/216 |
| 2016/0037949 | A1 | 2/2016 | Dawson et al. | |
| 2017/0282498 | A1* | 10/2017 | Love | B32B 5/06 |

OTHER PUBLICATIONS

Bed Bath & Beyond Rubber Door Mat Frame and Monogram Inserts. 6 pages, 2017.

Mat Mates Interchangeable Door Mats. Jan. 8, 2017. 3 pages.

Written_Opinion for PCT/US2018/028471, dated Jul. 24, 2018. 4 pages.

PCT/US2018/028471. International Preliminary Report on Patentability, dated Oct. 22, 2019. 4 pages.

* cited by examiner

ROTATING DOOR MAT ASSEMBLY

CROSS-REFERENCE TO RELATED APPLICATION

The present application claims priority from U.S. Provisional Patent Application Ser. No. 62/488,194, filed on Apr. 21, 2017, which is incorporated herein by reference in its entirety.

BACKGROUND OF THE INVENTION

Field of the Invention

The present invention relates to door mats with rotating center mat inserts to display different designs.

Description of the Related Art

Typical door mats have a single design on a top surface so, if a homeowner wants to show a different design, the homeowner must get a whole new mat. It would be beneficial to provide a door mat assembly that includes multiple designs that can be changed according to the homeowner's desires, without having to purchase additional mats.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a door mat assembly includes a frame having a first side and an opposing second side. A first mat insert is inserted into the first side and a second mat insert is inserted into the second side. A mat insert has a first surface, an opposing second surface, a first tab insertable into the first side, and a second tab insertable into the second side. The mat insert is rotatable in the frame to place either one of the first and second surfaces at a top of the mat assembly.

In an alternative embodiment, the present invention provides a door mat assembly comprising a base frame having a top surface and a first mat insert removably attached to the base frame. The first mat insert has a first inner surface and a first outer surface. A second mat insert is removably attached to the base frame and hingedly connected to the first mat insert. The second mat insert has a second inner surface and a second outer surface. A first frame pivot assembly is rotatably inserted in the base frame. The first frame pivot assembly is adapted to allow the first mat insert and the second mat insert to rotate about the first frame pivot.

In still another alternative embodiment, the present invention provides a door mat assembly having a top surface. The door mat assembly comprises a base frame having a generally rectangular opening formed therein and a plurality of mat inserts. Each of the plurality of mat inserts has a first surface and an opposing second surface. The plurality of mat inserts are rotatable within the base frame such that alternately each of the first surface and the second surface of each of the plurality of mat inserts is adapted to form a portion of the top surface.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
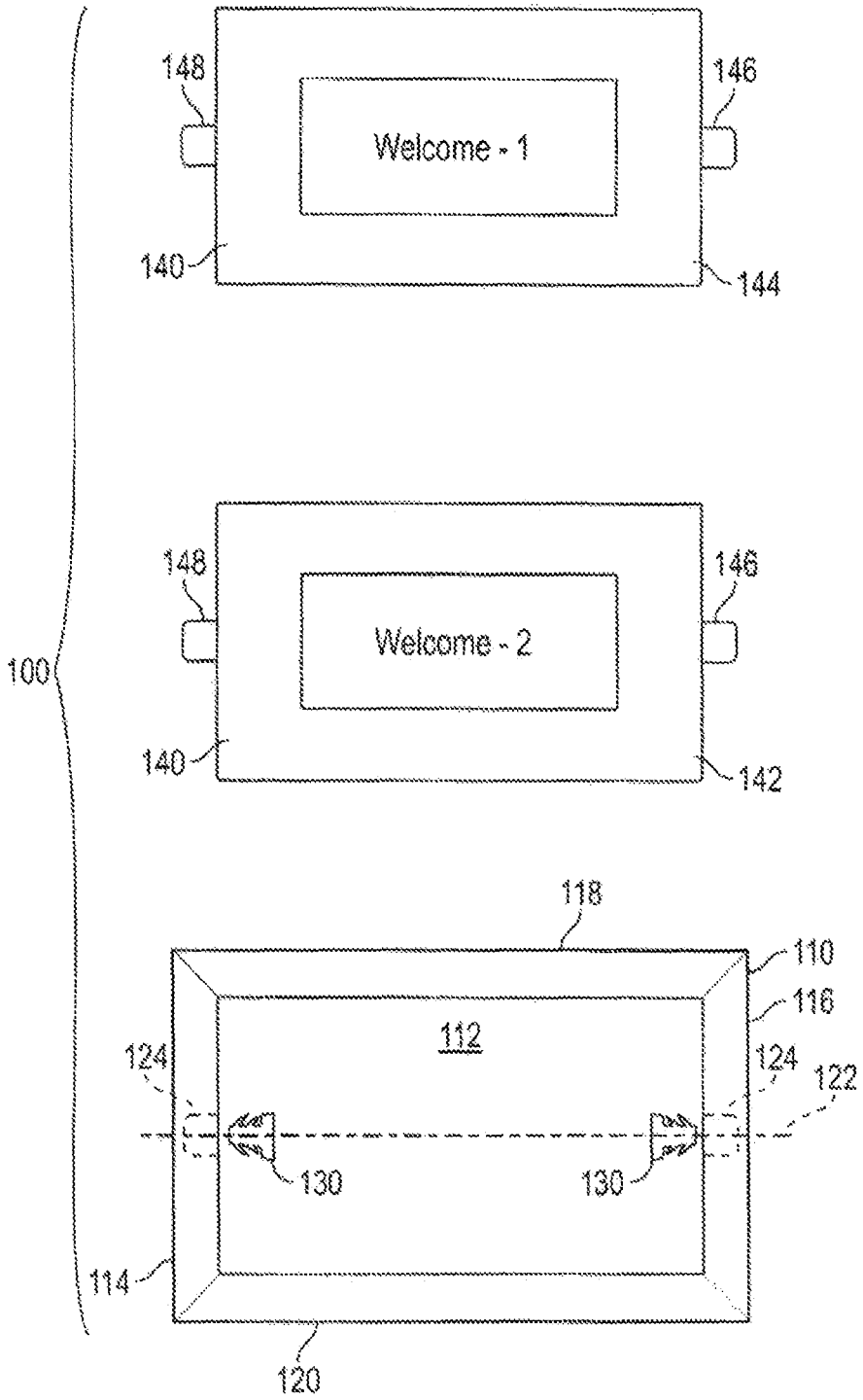
FIG. 1 is an exploded view of a mat assembly according to a first exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The present invention provides door mat assemblies that include multiple designs that can be used to provide different appearances to the door mat.

Figure 2:
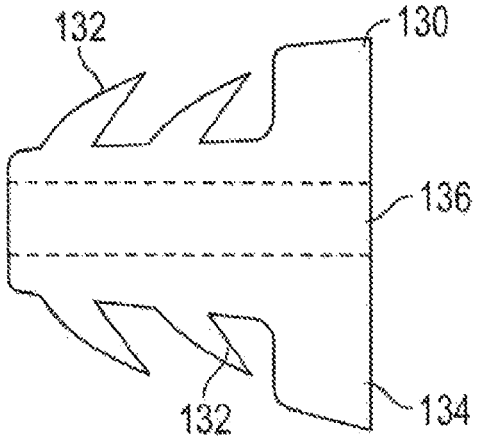
FIG. 2 is a side elevational view of an insert used with the mat assembly shown in FIG. 1.
Figure 3:
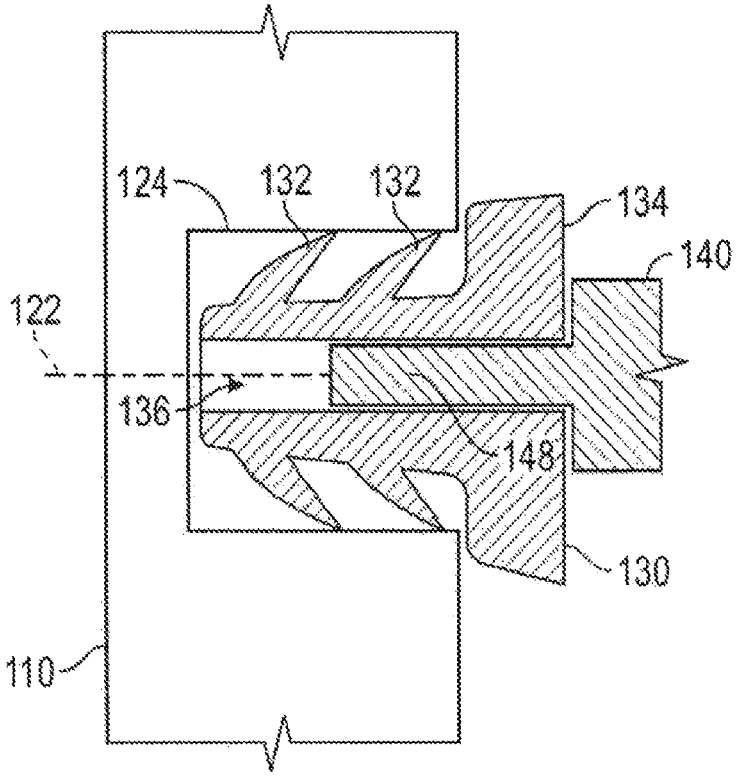
FIG. 3 is a side elevational view, in section, of a mat insert inserted into a mat frame of the assembly shown in FIG. 1.
Figure 4:
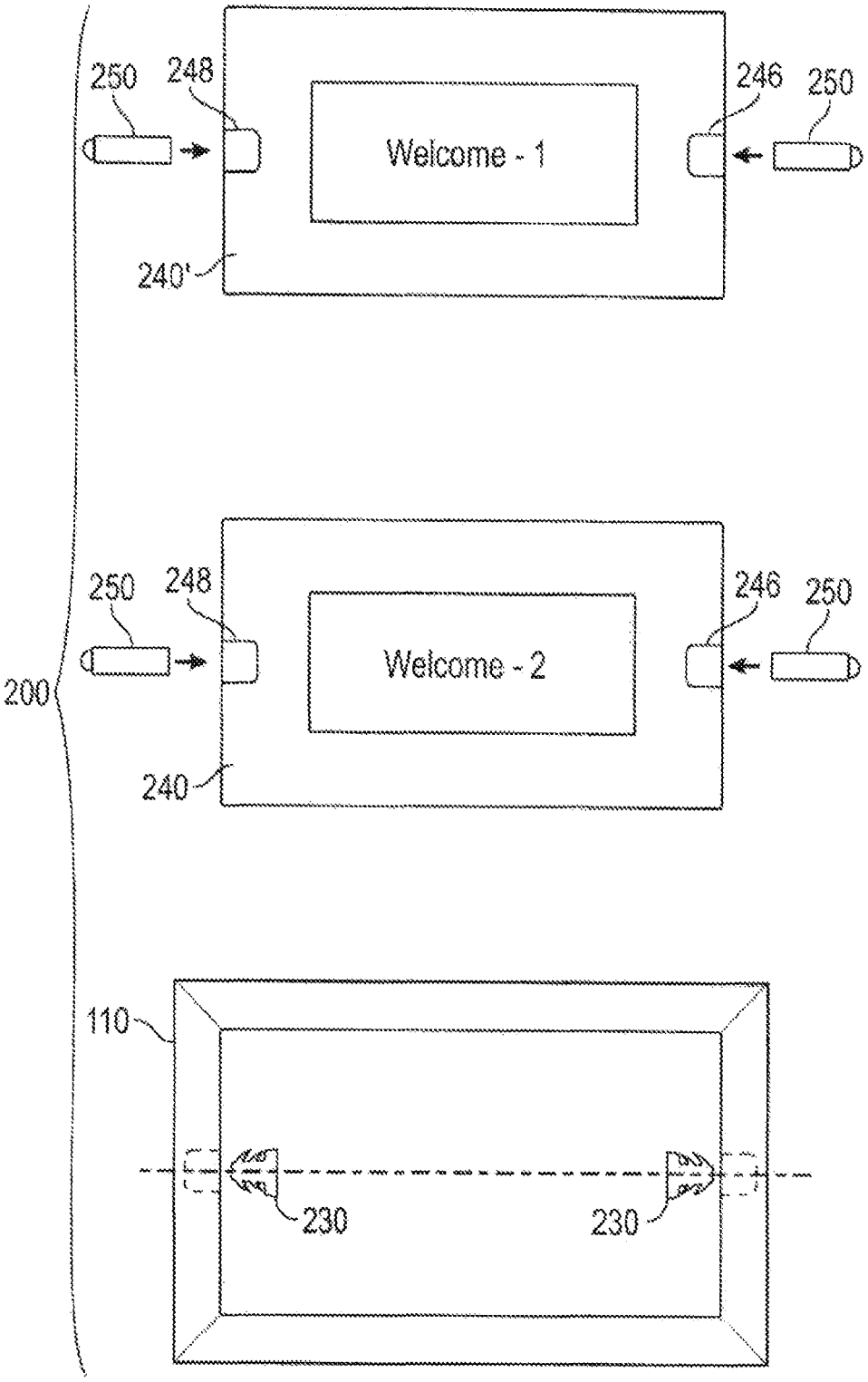
FIG. 4 is an exploded view of a mat assembly according to a second exemplary embodiment of the present invention.
Figure 5:
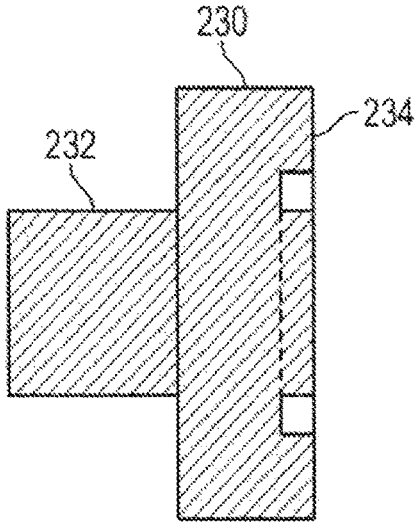
FIG. 5 is a side elevational view of an insert used with the mat assembly shown in FIG. 4.
Figure 6:
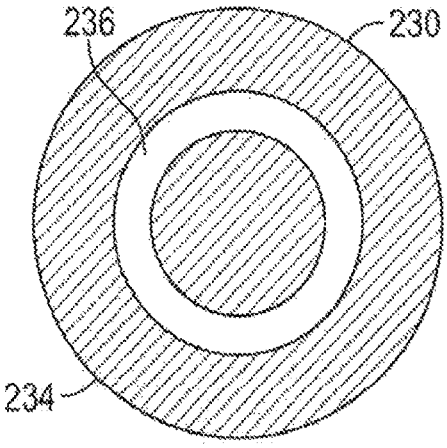
FIG. 6 is a front elevational view of the insert shown in FIG. 5.
Figure 7:
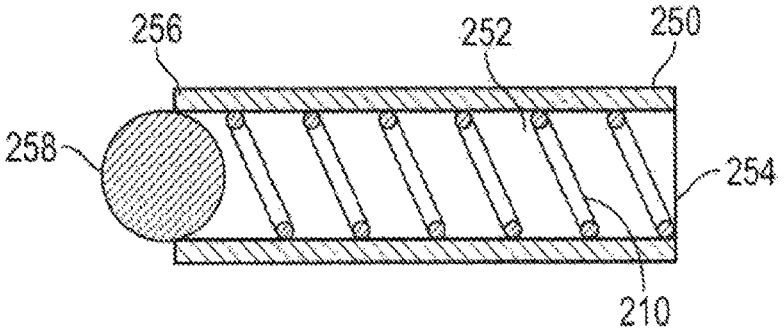
FIG. 7 is a side elevational view of a spring and ball pivot pin used with the mat assembly shown in FIG. 4.

Referring to FIGS. 1-3, a door mat assembly 100 ("assembly 100") according to a first exemplary embodiment of the present invention is shown. Assembly 100 includes a generally rectangular frame 110 having a smaller rectangular opening 112 formed therein such that frame 110 forms a border around opening 112. Frame 110 can be constructed from a resilient, yet pliable material, such as a rubber, or other suitable material. Optionally, frame 110 can be reinforced for strength and durability and/or constructed from a rigid material such as, for example, metal, plastic, or other suitable rigid material. Still optionally, frame 110 can have different designs on each of a top face and a bottom face.

Frame 110 has a first long side 118 and a second long side 120 that extends parallel to first long side 118. Frame 110 also includes a first short side 114 and a second short side 116 that extends parallel to first short side 114 such that short sides 114, 116 extend between long sides 118, 120. A longitudinal axis 122 extends between and parallel to first long side 118 and second long side 120. Also, frame 110 can include stiffening rods or bars extending along some or all of sides 114, 116, 118, 120 to enhance rigidity of frame 110, if desired.

Each short side 114, 116 along axis 122 includes a cylindrical slot 124 extending from opening 112 toward an exterior of frame 110. Slots 124 are sized to retain an insert 130. Insert 130 includes at least one barb 132 that is inserted into slot 124 so that insert 130 is retained within slot 124. Barb 132 can be located only on sides of insert 130 such that barb 132 does not extend upwardly or downwardly from mat frame 110 to avoid bulging out of mat frame 110. Insert 130 also includes a generally annular flange 134 that engages the short side 114, 116 at which insert 130 is being used.

Insert 130 includes an opening 136 at flange 134 that extends toward barb 132. Optionally, opening 136 can extend the length of insert 130, forming a hollow through-passage. When inserted into slots 124, each opening 136 extends along axis 122. Insert 130 can be constructed from a hard plastic such as, for example, ultra-high molecular weight polyethylene, or other suitable material.

A mat insert 140 is insertable into opening 112. Mat insert 140 has dimensions similar to the dimensions of opening 112 so that mat insert 140 can be inserted within opening 112 with a minimum of space between mat insert 140 and frame 110 to allow rotation of insert 140 within frame 110 as well as for drainage.

Mat insert 140 can be constructed from a resilient, yet pliable material, such as a rubber or other suitable material. Optionally, mat insert 140 can be reinforced for strength and durability. Mat insert 140 has a top surface 142 and an opposing bottom surface 144. Each of top surface 142 and bottom surface 144 can have different designs such that mat insert 140 can be rotated within frame 110 to display a different design.

Mat insert 140 includes a pair of opposing tabs 146, 148 that are insertable into openings 136 in each insert 130 such that tabs 146, 148 extend along axis 122. Tabs 146, 148 are constructed from different materials than insert 130 to reduce friction produced by having like-on-like materials, resulting in easier rotation of mat insert 140 with respect to frame 110.

Mat insert 140 is sufficiently pliant so that tab 146 can be inserted into its respective opening 136 and mat insert 140 is insertable into opening 112 and mat insert 140 can be contoured to allow tab 148 to be inserted into its respective opening 136. Mat insert 140 can be flattened to rest inside opening 112.

With different designs on each of frame 110 and mat insert 140, mat assembly 100 can be configured to display up to four different design looks. Further, the rotatability of both frame 110 and mat insert 140 reduces the wear on each, resulting in a longer lifetime of assembly 100.

An alternative embodiment of a mat assembly 200 ("assembly 200") according to the present invention is shown in FIGS. 4-7. Assembly 200 is similar to assembly 100 but, instead of using inserts 130 with a single opening 136, assembly 200 includes inserts 230, shown in FIGS. 5 and 6, that include a first end 232 that is inserted into slot 124 and a second end 234 having a generally annular slot 236 formed therein.

Also, instead of mat insert 140 having tabs 146, 148, a mat insert 240 can include internal slots 246, 248 that receive spring and ball pivot pins 250. Each ball retainer 250, shown in FIG. 7, includes a hollow tube 252 having a closed end 254 and an open end 256. A ball 258 is disposed within and retained by open end 256. Ball 258 can include a detent to retain ball 238 in open end 256. A biasing member 260, such as a spring, is disposed in tube 252 and biases ball 258 outwardly from tube 252. Ball pivot pin 250 is inserted into each slot 246, 248 so that ball 258 extends outwardly from mat insert 240.

Spring and ball pivot pin 250 is inserted into annular slot 236 so that ball 258 rides in slot 236, enhancing the ability to rotate mat insert 240 around annular slot 236. Annular slot 236 allows for the insertion of a second mat insert 240' to be used with mat insert 240. Each mat insert 240, 240' can have designs on each side, allowing for four different mat insert designs to be used with assembly 200.

To insert spring and ball pivot pins 258 into annular slot 236, ball 258 is pressed against annular slot 236 such that ball 258 is biased inside tube 252. When ball 258 is aligned with slot 236, biasing member 260 biases ball 258 into annular slot 236.

With mat inserts 240, 240' adjacent each other, two of the four mat faces are exposed and can easily be placed at the top of assembly 200 by rotating both mat inserts 240, 240' together around annular slot 236. To view one of the internal mat faces, one of mat inserts 240, 240' is first removed from frame 110. The removed mat insert 240, 240' can then be rotated to show its internal face and then reinstalled in frame 110. Alternatively, the remaining mat inserts 240', 240 can be rotated to place its internal face downward. The removed mat insert 240, 240' is then reinstalled in frame 110 and mat inserts 240, 240' are rotated in annular slot 236 to put the desired face facing upward.

Another alternative embodiment of a mat assembly 300 ("assembly 300") according to the present invention is shown in FIGS. 8-24. Assembly 300 includes a generally picture frame-shaped base frame 310 that has a rectangular outer perimeter 312 with a top surface 314 and a rectangular inner opening 316. Base frame 310 includes a first short side 302 and a parallel second short side 304. A first long side 306 connects one end of each of the first and second short sides 302, 304, while a second long side 308 connects opposing ends of the first and second short sides 302, 304.

A mat insert assembly 318 is removably and rotatably attached to base frame 310 inside the inner opening 316 and includes mat inserts 320, 322. The second mat insert 322 is hingedly connected to the first mat insert 320 via a connecting member 323 (shown in FIG. 8A) so that the first mat insert 320 can be rotated to face and engage the second mat insert 322. Alternatively, the first mat insert 320 can be connected to the second mat insert 322 via a living hinge, or other suitable connecting mechanism. Mat inserts 320, 322 can be constructed from a flexible material, such as woven or unwoven cloth, rubber, soft plastic, or any other suitable material or combination thereof.

Figure 8:
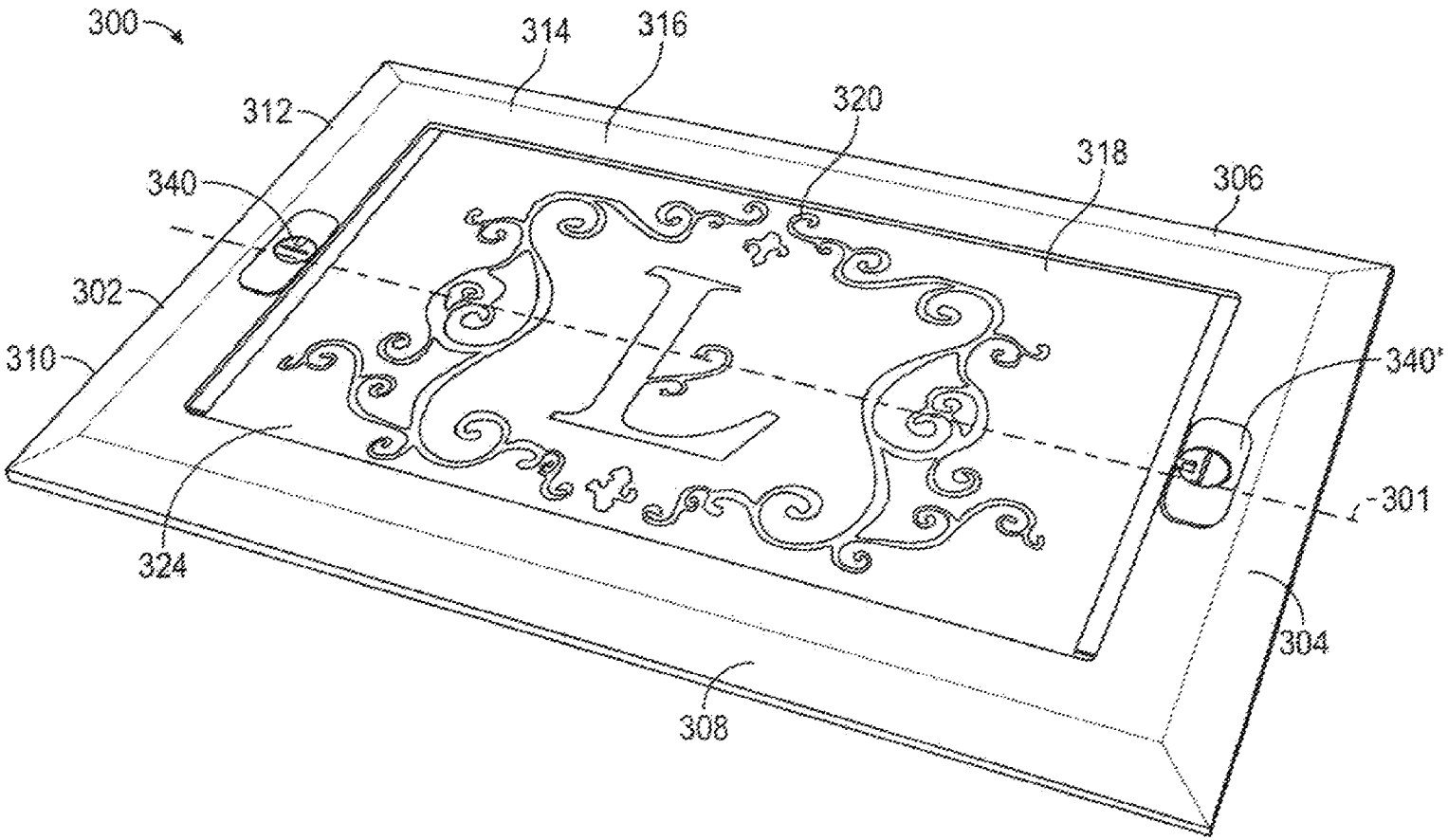
FIG. 8 is a perspective view of a mat assembly according to an alternative exemplary embodiment of the present invention.
Figure 8A:
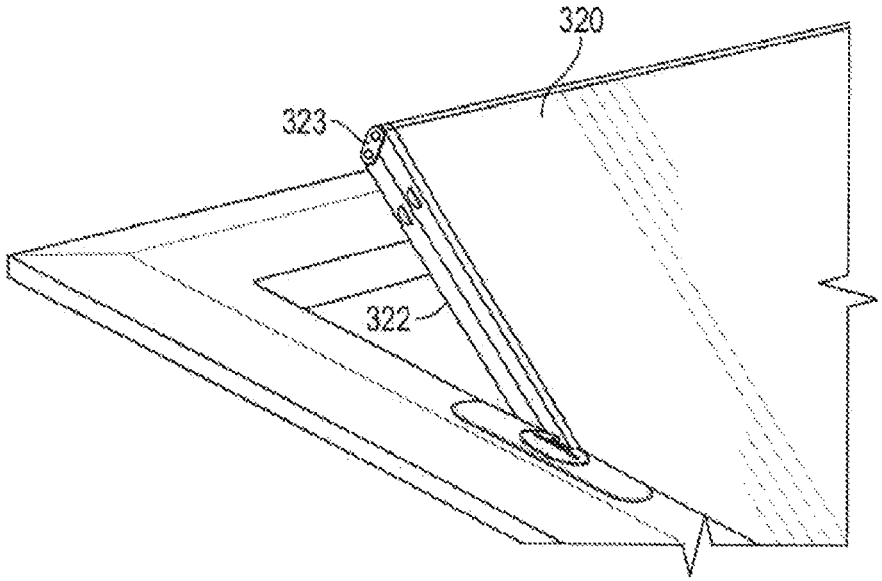
FIG. 8A is an enlarged perspective view of a corner of the mat assembly of FIG. 8, partially rotated.

As shown in FIGS. 19-23, each mat insert 320, 322 has an outer surface 324, 326, respectively, and an opposing inner surface 328, 330. The outer surfaces 324, 326 and the inner surfaces 328, 330 can flip to become the other of an inner surface 328, 330 and an outer surface 324, 326, depending on the configuration of the mat insert assembly 318, such that any of surfaces 324-330 can be displayed as shown in FIG. 8.

Figure 9:
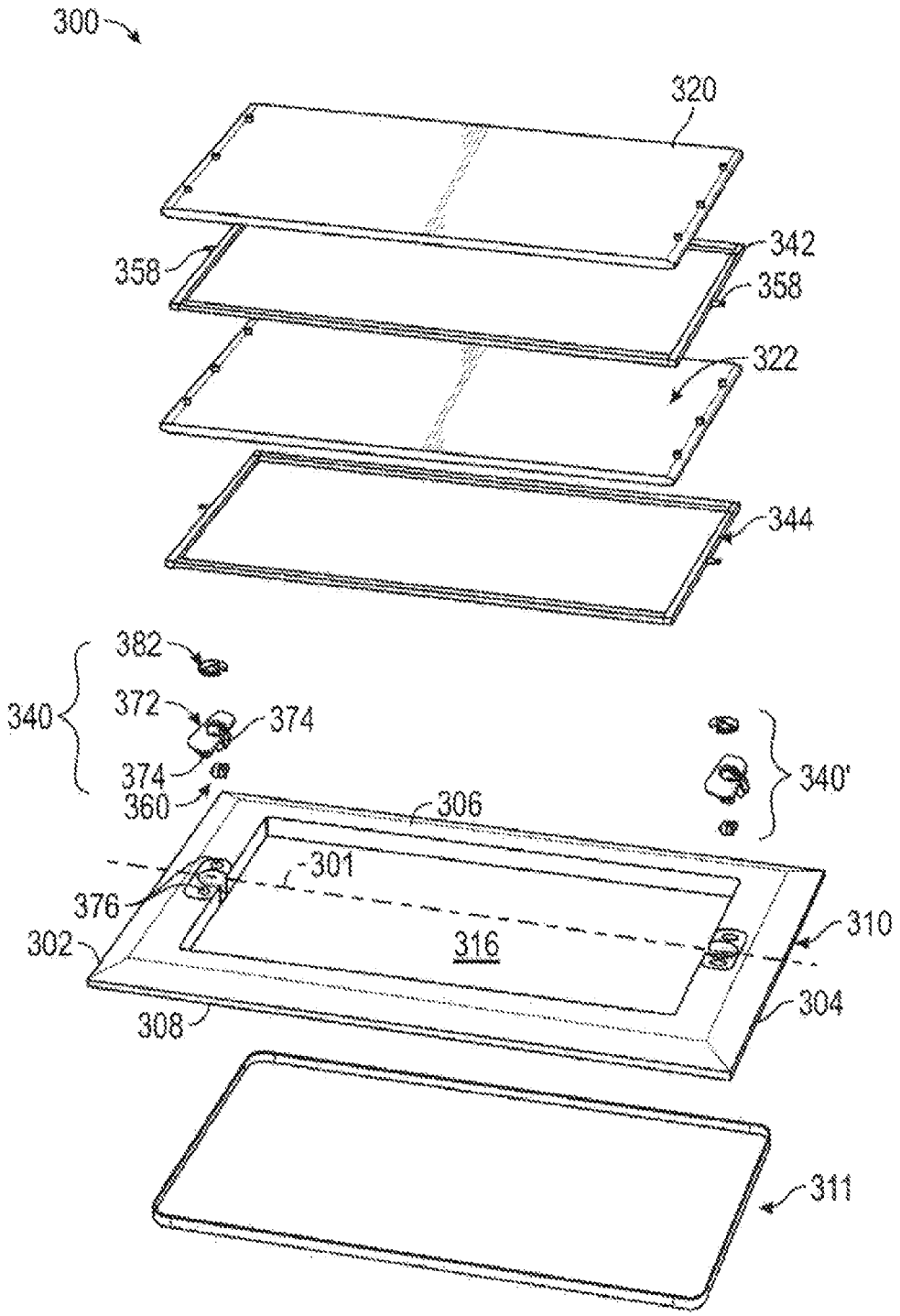
FIG. 9 is an exploded perspective view of the mat assembly of FIG. 8.

FIG. 9 shows an exploded view of an exemplary configuration of assembly 300. Base frame 310 can include a reinforcing strip 311. Strip 311 can be constructed from a metal or other rigid material to provide structural strength and rigidity to base frame 310. Strip 311 can be integrally formed into base frame 310 or, alternatively, strip 311 can be inserted into the bottom of base frame 310 after base frame 310 is formed.

A first frame pivot assembly 340 is rotatably inserted in the base frame 310, on the first short side 302. A second pivot assembly 340' is rotatably inserted in the base frame 310, on the second short side 304, along a central longitudinal axis 301 of the frame 310. The second pivot assembly 340' is identical to the first pivot assembly 340, so only the first pivot assembly 340 will be discussed. The first frame pivot assembly 340 is adapted to allow the first mat insert 320 and the second mat insert 322 to rotate about the first frame pivot assembly 340.

Figure 10:
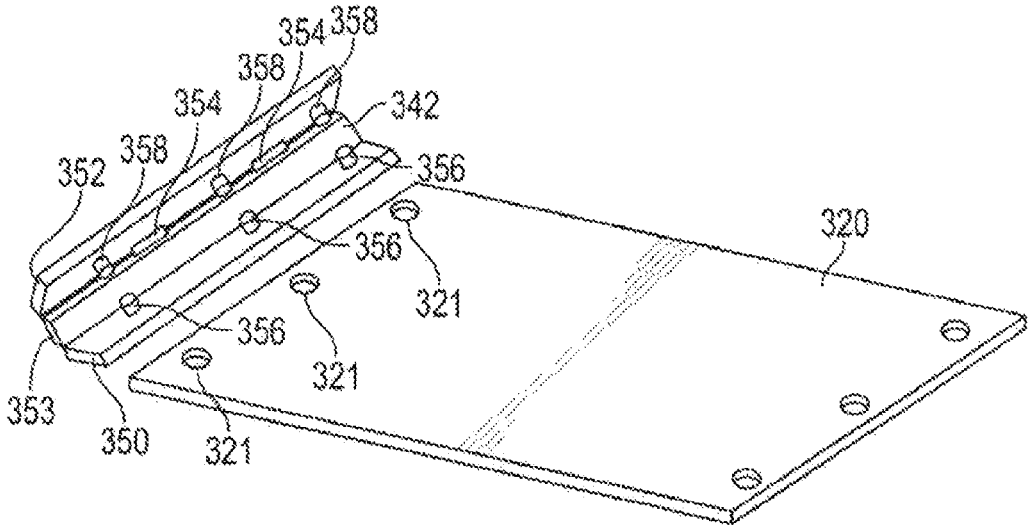
FIG. 10 is an exploded perspective view of a mat insert and mat frame of the assembly of FIG. 8.
Figure 11:
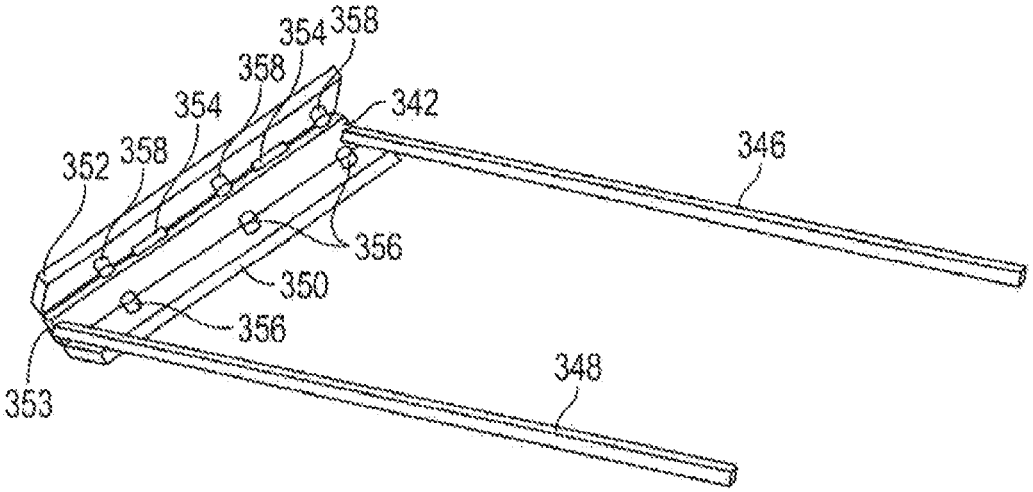
FIG. 11 is an alternative embodiment of the mat frame of FIG. 10.

Each mat insert 320, 322 is removably mounted in and attached to a mat frame 342, 344, respectively. Mat frames 342, 344 can be identical, so only mat frame 342 will be discussed. As shown in FIG. 10, mat frame 342 can be a side only frame or, alternatively, as shown in FIGS. 9 and 11, mat frame 342 can include longitudinal struts 346, 348 (shown in FIG. 11) that extend along the longitudinal sides of the mat insert 320.

Mat frame 342 includes a lower portion 350 connected to a central member 353 and an upper portion 352 that is connected to central member 353 by a plurality of hinges 354. Mat insert 320 can include a plurality of through openings 321 along the short side of the mat insert 320 and the mat frame 342 can include a like plurality of posts 356 that are sized and located to fit into the through openings 321 to removably secure the mat insert 320 to the mat frame 342. The upper portion 352 can include a like plurality of posts 358 that can magnetically engage with posts 356. The upper portion 352 can be pivoted about the hinges 354 so that posts 356, 258 meet inside the through openings 321 to removably attach the mat frame 342 to the mat insert 320.

Figure 12:
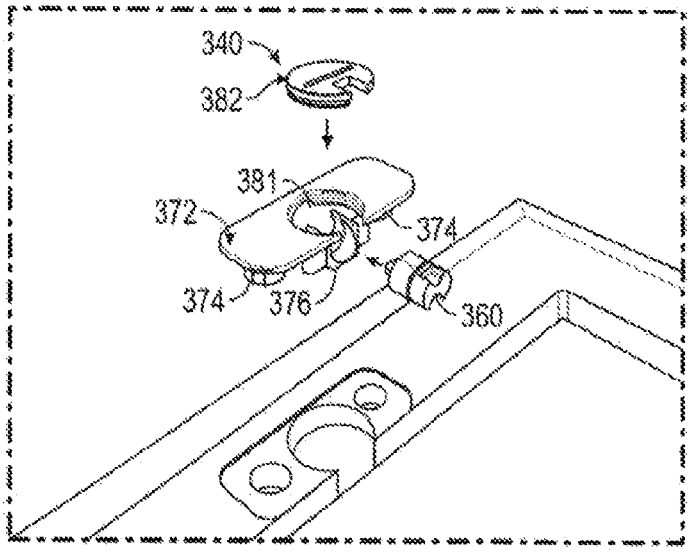
FIG. 12 is an enlarged perspective view of a frame pivot assembly used with the assembly of FIG. 8.
Figure 13:
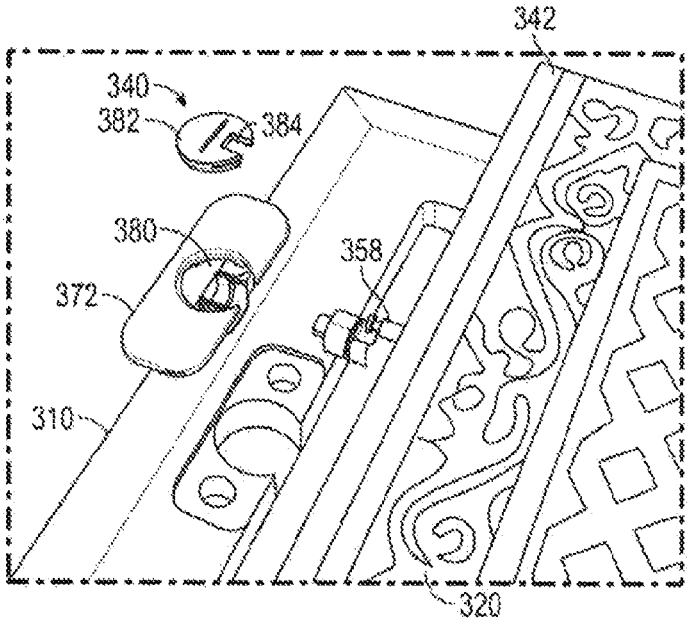
FIG. 13 is an enlarged perspective view of the frame pivot assembly of FIG. 12, with a mat insert and frame.

Referring to FIG. 12, mat frame 342 includes a prong 358 extending outwardly from either side thereof and along axis 301 when the mat frame 342 is inserted into the base frame 310. Prong 558 is generally cylindrical to allow mat frame 342 to rotate when the prong 358 is inserted into the base frame 310. The prong 358 includes a circumferential groove 359 that forms a retainer to releasably hold the prong into a respective frame pivot assembly 340, 340', as will be discussed in more detail below.

As shown in FIGS. 12-15, the first frame pivot assembly 340 includes a rotating assembly that is rotatably mounted in the base frame 310 and connects the mat inserts 320, 322 such that the mat inserts 320, 322 are rotatable with respect to the base frame 310. The first frame pivot assembly 340 includes a hinge barrel 360, which is adapted to alternatively allow one of the first outer surface 324 and the second outer surface 326 to align with the top surface 314 of the base frame 310. Each of the mat frames 342, 344 is rotatably inserted into a respective barrel 360, and the barrel 360 is rotatably inserted into the base frame 310.

The barrel 360 includes a centralized front lip 362 that engages the lower portion of the groove 359 in the prong 358. A slot 364, located behind the lip 362, retains the prong 358. The groove 359 can rotate on the lip 362, allowing the mat frame 320 to rotate about the prong 358.

Figure 14:
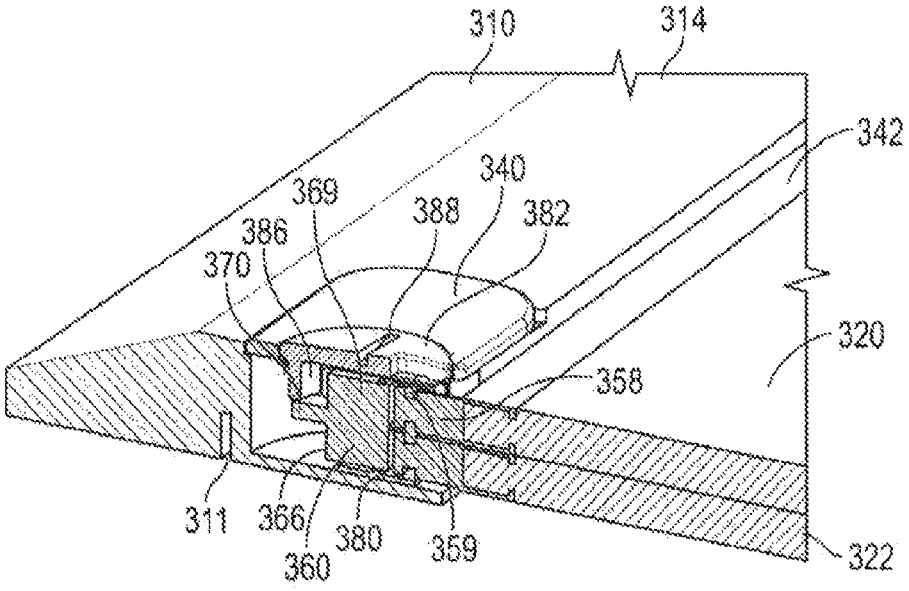
FIG. 14 is a sectional view of the frame pivot assembly and mat insert of FIG. 13, with the barrel locked in a non-rotating position.

The barrel 360 also includes a main body 366 located behind the slot 364. The body 366 includes a circumferential groove 369 formed therein. The groove 369 is used to retain the barrel 360 in the first frame pivot assembly 340. A flange 370 extends outwardly from the rear of the body 366. As shown in FIG. 14, when the barrel 360 is rotated such that the mat inserts 320, 322 are within the base frame 310, the flange 370 is in a generally horizontal position.

The barrel 360 is mounted in and covered by a removable hinge trap 372. The hinge trap 372 is removably mounted in the base frame 310. The hinge trap 372 includes a pair of locator pins 374 that are spaced to fit into corresponding openings 376 in the base frame 310. The hinge trap 372 also includes a base portion 378 that rotatably supports the barrel 360 such that the barrel 360 is rotatable to alternatively allow one of the first mat frame 342 and the second mat frame 344 to be removed from the barrel 360. The base portion 378 extends in an arc of over 280 degrees so that the barrel 360 is unable to be vertically removed from the base portion 378. Additionally, the base portion 378 includes an arcuate rib 380 that engages the groove 369 in the barrel body 366 so that the barrel 360 is unable to move longitudinally within the base portion 378.

Figure 15:
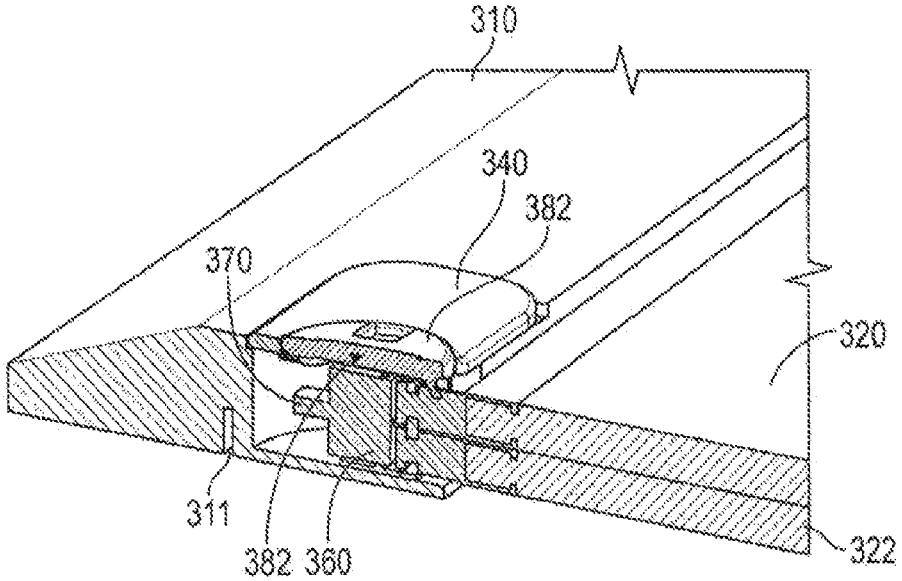
FIG. 15 is a sectional view of the frame pivot assembly and mat insert of FIG. 13, with the barrel unlocked in a rotatable position.
Figure 16:
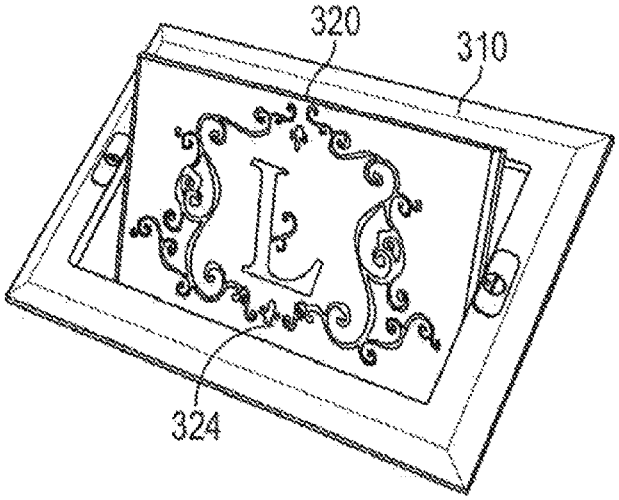
FIG. 16 is a perspective view of the mat assembly of FIG. 8, with the mat inserts beginning to be rotated.
Figure 17:
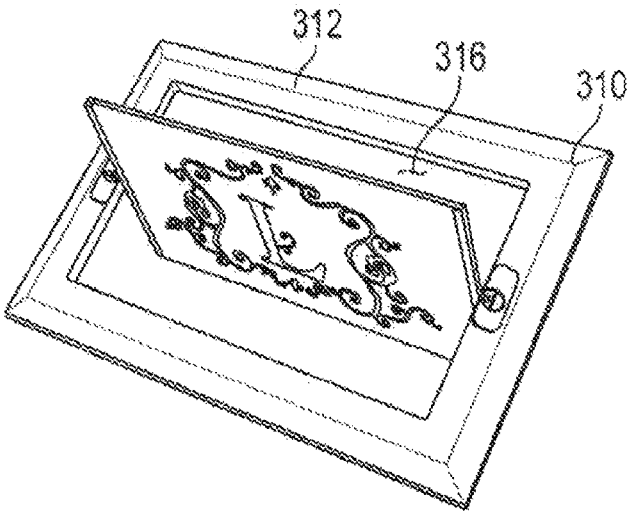
FIG. 17 is a perspective view of the mat assembly of FIG. 8, with the mat inserts rotated about half way.
Figure 18:
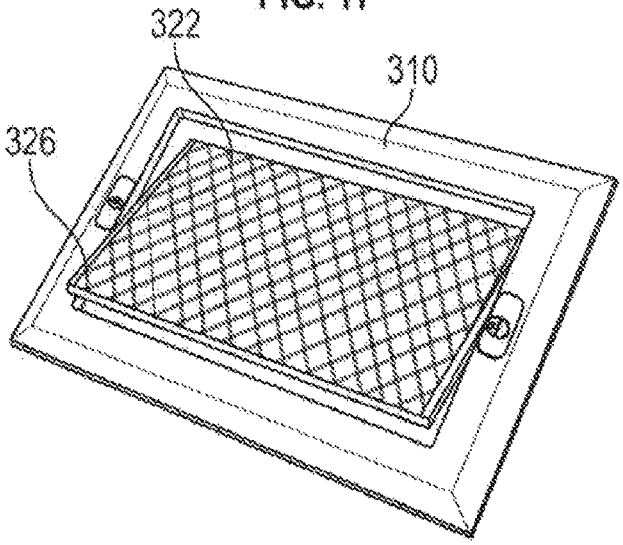
FIG. 18 is a perspective view of the mat assembly of FIG. 8, with the mat inserts almost totally rotated.
Figure 19:
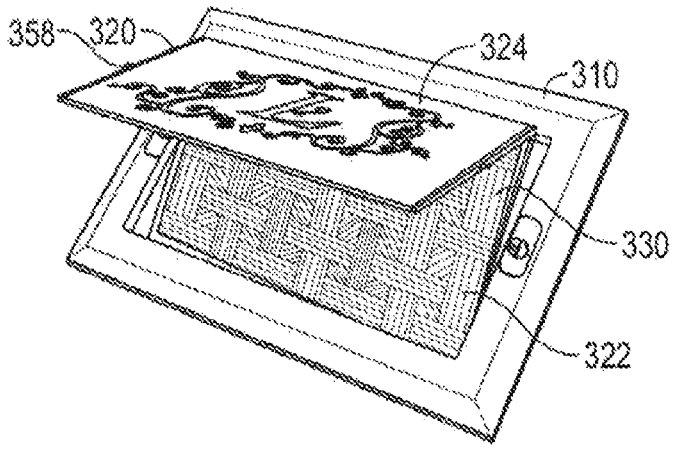
FIG. 19 is a perspective view of the mat assembly of FIG. 8, with a top mat insert removed from its frame pivot assemblies in the base frame.
Figure 20:
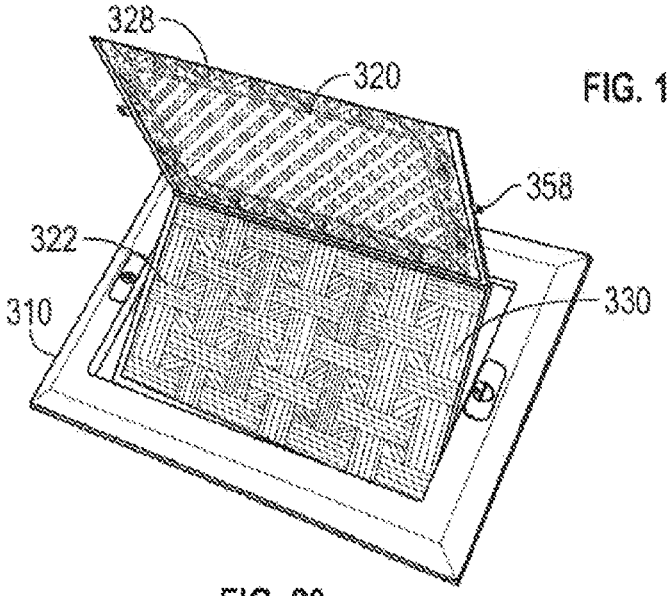
FIG. 20 is a perspective view of the mat assembly of FIG. 19, with a bottom mat insert beginning to rotate about its frame pivot assemblies.
Figure 21:
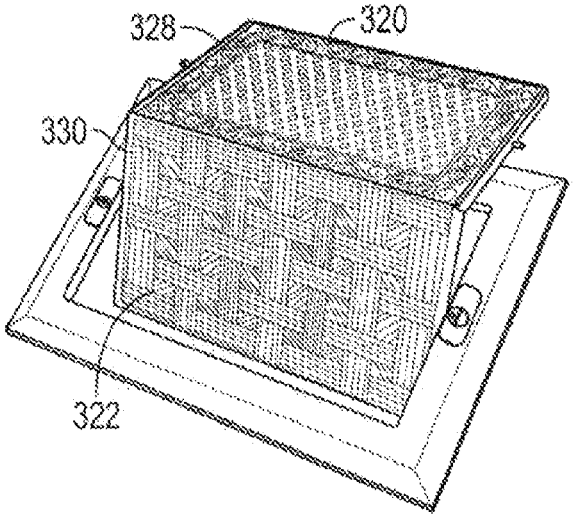
FIG. 21 is a perspective view of the mat assembly of FIG. 20, with the bottom mat insert further rotated about its frame pivot assemblies.
Figure 22:
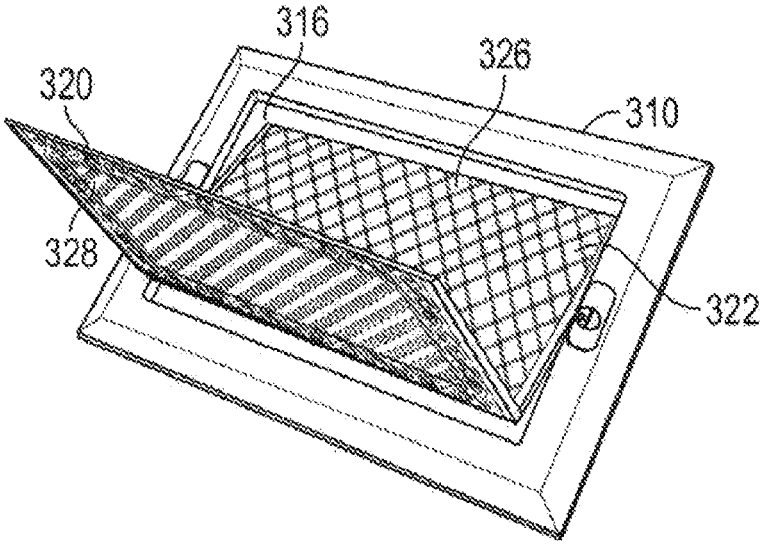
FIG. 22 is a perspective view of the mat assembly of FIG. 21, with the bottom mat almost completely rotated about its frame pivot assemblies.
Figure 23:
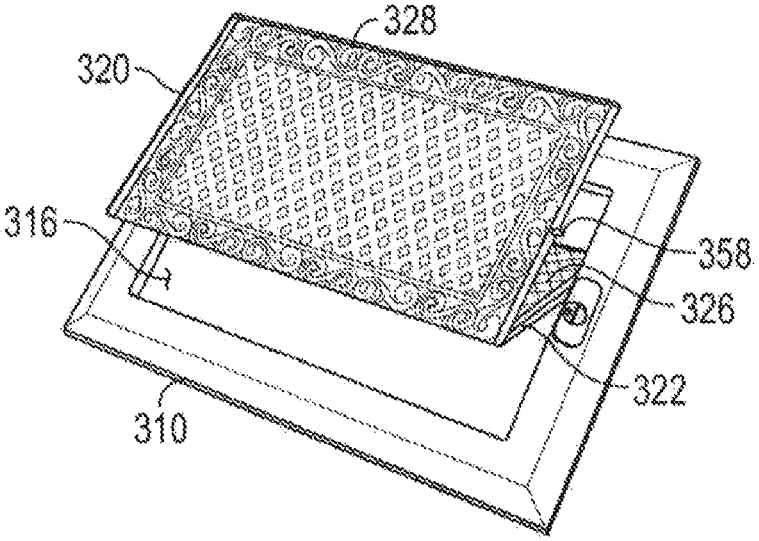
FIG. 23 is a perspective view of the mat assembly of FIG. 22, with the top mat insert being rotated against the bottom mat insert.
Figure 24:
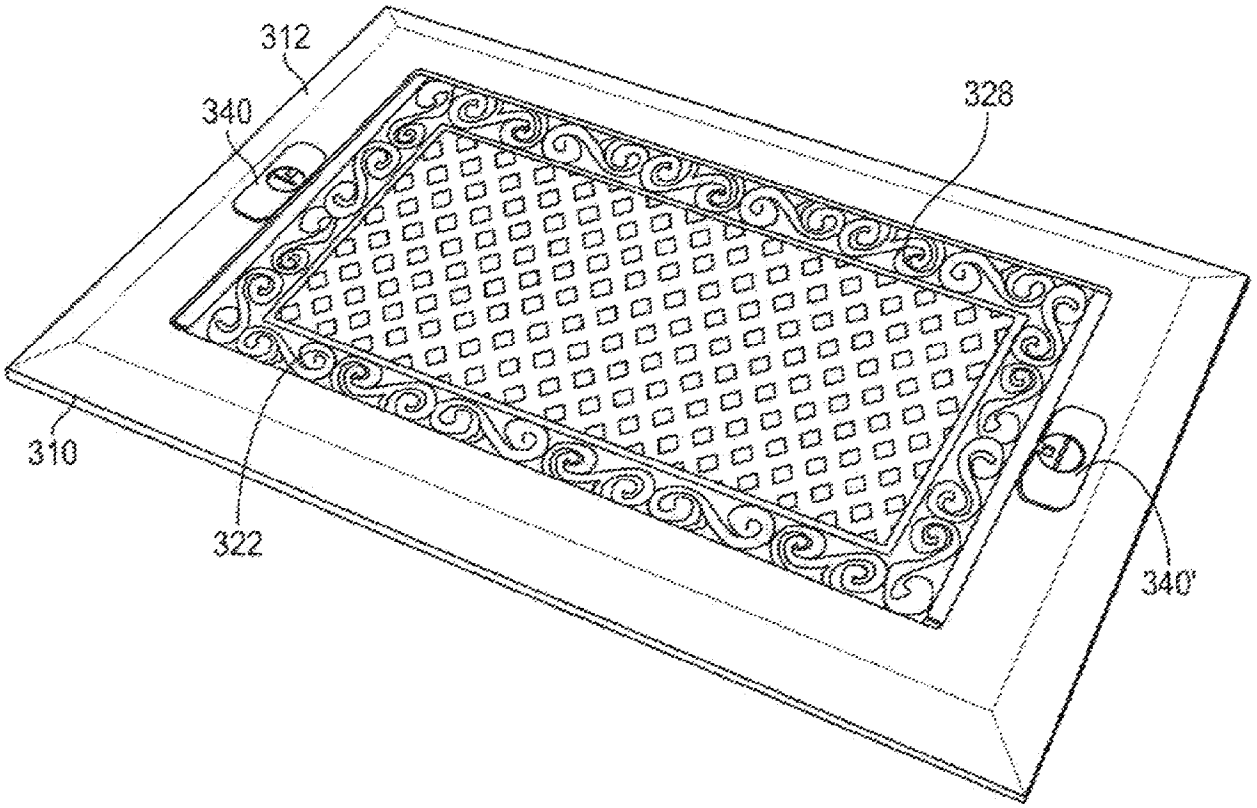
FIG. 24 is a perspective view of the mat assembly of FIG. 23, with the top mat insert being reinserted into the base frame.

A top portion of the hinge trap 372 has an opening 381 that is removably covered by a locking cover 382. The locking cover 382 is rotatably mounted in the opening 380 over the barrel 360 and includes an opening 384 that is sized to allow the prong 358 to be removed from the first frame pivot assembly 340 in order to be able to rotate the mat inserts 320, 322 to expose different sides of the mat inserts 320, 322. The locking cover 382 includes a tang 386 that extends downwardly into the base frame 310. Referring to FIGS. 14 and 15, the locking cover 382 is rotatable to a first position wherein the tang 386 does not engage the flange 370 and the barrel 360 is rotatable within the base frame 310 (FIG. 15) and rotatable to a second position wherein tang 386 is engaged by the flange 370 (FIG. 14) such that the barrel 360 is non-rotatable within the base frame 310. When the locking cover 382 is in the second position, the opening 384 is over the prong 358 such that the prong 358 can be lifted from the barrel 360 and through the opening 384 so that the mat insert 320 can be removed from the base frame 310.

The locking cover 382 includes a slot 388 formed in the top thereof so that a screwdriver, a coin, or other flat item can be inserted therein to rotate the locking cover 382 between the first position and the second position. Optionally, the locking cover 382 can include a living hinge that connects the locking cover 282 to the hinge trap 372 so that the locking cover 382 cannot be inadvertently disassociated from the rest of the assembly 300.

In operation, referring to FIGS. 8 and 16-18, assembly 300 can be placed on the ground with the first outer surface 324 of the first mat insert 320 on display within the top surface of the base frame 310. If the second outer surface 326 of the second mat insert 322 is desired to be viewed, the locking cover 382 is rotated to the position shown in FIG. 15, such that the tang 386 does not engage the flange 370. The base frame 310 is at least partially picked up from the ground so that the entire barrel 360 can be rotated about 180 degrees within its respective frame pivot assembly 340 so that mat inserts 320, 322 rotate from the position shown in FIG. 8 to the position shown in FIG. 18. Assembly 300 is then placed back onto the ground.

If one of the inner surfaces 328, 330 is desired to be placed at the top of assembly 300, the locking covers 382 on both frame pivot assemblies 340, 340' are aligned so that the opening 384 is aligned with a respective prong 358 on either side of mat frame 342. The prongs 358 are removed from their respective barrels 360 and the remaining mat frame 344 is rotated about its prongs 358 from the position shown in FIG. 8, through the positions shown in FIGS. 19-23, to the position shown in FIG. 24. As this rotation is accomplished, tang 386 engages flange 370 and barrel 360 remains stationary so that prongs 358 of mat frame 342 can be reinserted into their respective barrels 360. Assembly 300 is then placed back onto the ground.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A door mat assembly comprising:

a base frame having a top surface;

a first mat insert removably attached to the base frame, the first mat insert having a first inner surface and a first outer surface;

a second mat insert removably attached to the base frame and hingedly connected to the first mat insert, the second mat insert having a second inner surface and a second outer surface; and a first frame pivot assembly rotatably inserted in the base frame, the first frame pivot assembly adapted to allow the first mat insert and the second mat insert to rotate about the first frame pivot assembly.

2. The door mat assembly according to claim 1, wherein the first frame pivot assembly comprises a barrel adapted to alternatively allow one of the first outer surface and the second outer surface to align with the top surface of the base frame.

3. The door mat assembly according to claim 2, wherein the first frame pivot assembly comprises a locking cover mounted over the barrel and rotatable to a first position wherein the barrel is rotatable within the base frame and rotatable to a second position wherein the barrel is non-rotatable within the base frame.

4. The door mat assembly according to claim 3, wherein, when the locking cover is in the second position, the first mat insert is removable from the base frame.

5. The door mat assembly according to claim 3, wherein the barrel comprises a flange and wherein the locking cover comprises a tang such that, when the locking cover is in the second position, the flange engages the tang.

6. The door mat assembly according to claim 2, wherein the barrel engages a first mat frame removably inserted therein, the first mat frame being adapted to receive and retain the first mat.

7. The door mat assembly according to claim 6, wherein the barrel further engages a second mat frame removably inserted therein, the second mat frame being adapted to receive and retain the second mat.

8. The door mat assembly according to claim 7, wherein the barrel is rotatable to alternatively allow one of the first mat frame and the second mat frame to be removed from the barrel.

9. The door mat assembly according to claim 5, wherein the second mat insert hingedly connected to the first mat insert.

10. The door mat assembly according to claim 5, wherein the first mat insert is removably attached to a first mat frame and the second mat insert is removably attached to a second mat frame, and wherein the first mat frame and the second mat frame are removably attached to the base frame.

11. The door mat assembly according to claim 10, wherein the second mat frame is hingedly connected to the first mat frame via a connecting member.

12. The door mat assembly according to claim 1, wherein the first mat insert is adapted to be rotated to face and engage the second mat insert.

* * * * *